US010123666B2

(12) United States Patent
Ruthven et al.

(10) Patent No.: US 10,123,666 B2
(45) Date of Patent: Nov. 13, 2018

(54) SYSTEM AND METHOD FOR REDUCING WASTE USING A SHEET PRODUCT DISPENSER

(71) Applicant: GPCP IP Holdings LLC, Atlanta, GA (US)

(72) Inventors: Paul James Ruthven, Neenah, WI (US); Lisa Hedden, Dunwoody, GA (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 0 days.

(21) Appl. No.: 15/399,301

(22) Filed: Jan. 5, 2017

(65) Prior Publication Data

US 2017/0112336 A1 Apr. 27, 2017

Related U.S. Application Data

(63) Continuation of application No. 13/998,753, filed on Dec. 2, 2013.

(60) Provisional application No. 61/731,812, filed on Nov. 30, 2012.

(51) Int. Cl.
*A47K 10/36* (2006.01)

(52) U.S. Cl.
CPC ..... *A47K 10/3687* (2013.01); *A47K 10/3643* (2013.01)

(58) Field of Classification Search
CPC ..... A47K 10/36; A47K 10/3612; A47K 10/3687; A47K 10/3643
See application file for complete search history.

(56) References Cited

U.S. PATENT DOCUMENTS 2,193,759 A * 3/1940 Birr ..... A47K 10/3643 125/11.16
2,487,763 A 11/1949 Wallace M Patterson et al.
2,738,934 A * 3/1956 Dobkin William J ..... A47K 10/3687 242/560.1
3,007,650 A * 11/1961 Burton ..... A47K 10/3687 242/560.1
3,089,659 A 5/1963 Perrin
3,157,370 A 11/1964 Govatsos et al.
(Continued)

FOREIGN PATENT DOCUMENTS

WO WO 2015/066644 A2 5/2015

*Primary Examiner* — Michael E Gallion
(74) *Attorney, Agent, or Firm* — Nelson Mullins Riley & Scarborough LLP

(57) ABSTRACT

A method of reducing sheet product waste generated during use of a sheet product dispenser in a particular location and over a broad range of usage rates includes designing a dispenser. The design includes determining a desired housing size to obtain a top to bottom height for sheet product roll storage within the housing, dividing the height by two to obtain a maximum roll diameter, locating two roll holders in the housing so that each holder may accept a roll having the maximum roll diameter, positioning a first roll of the maximum roll diameter in a first one of the two roll holders, and positioning a second roll of the maximum roll diameter in a second one of the two roll holders so that two rolls of equivalent length are configured to be dispensed sequentially from the dispenser. The installation and use of two rolls of maximum roll diameter reduces waste. Dispensers formed according to this method are also described.

16 Claims, 8 Drawing Sheets

(56) References Cited

U.S. PATENT DOCUMENTS 3,223,344 A 12/1965 Weymouth
3,387,902 A * 6/1968 Perrin Jack L ..... A47K 10/24 242/560.3
3,474,977 A 10/1969 Mott, Sr. et al.
3,628,743 A * 12/1971 Bastian ..... A47K 10/32 242/560.1
3,650,487 A 3/1972 Bahnsen
3,770,222 A 11/1973 Jespersen
3,858,951 A 1/1975 Rasmussen
3,865,295 A * 2/1975 Okamura ..... A47K 10/38 225/47
3,917,191 A * 11/1975 Graham, Jr. ..... A47K 10/3687 226/11
4,010,909 A * 3/1977 Bastian ..... A47K 10/3687 226/91
4,067,509 A * 1/1978 Graham, Jr. ..... A47K 10/3687 242/560.1
4,137,805 A * 2/1979 Deluca ..... A47K 10/3687 226/110
4,139,168 A 2/1979 Alberding
4,148,442 A * 4/1979 Baumann ..... A47K 10/3687 242/560.1
4,165,138 A * 8/1979 Hedge ..... A47K 10/3656 242/560
4,203,562 A * 5/1980 Deluca ..... A47K 10/3687 242/560.1
4,206,858 A * 6/1980 DeLuca ..... A47K 10/3687 225/106
4,260,117 A 4/1981 Perrin et al.
4,267,752 A * 5/1981 Byrt ..... B26D 1/626 83/311
4,358,169 A * 11/1982 Filipowicz ..... A47K 10/3687 225/34
4,487,375 A * 12/1984 Rasmussen ..... A47K 10/3687 226/174
4,552,315 A 11/1985 Granger
4,564,148 A 1/1986 Wentworth
4,634,192 A 1/1987 Fielding
4,666,099 A * 5/1987 Hoffman ..... A47K 10/3687 225/10
4,756,485 A * 7/1988 Bastian ..... A47K 10/3687 242/560.1
4,844,361 A 7/1989 Granger
4,846,412 A * 7/1989 Morand ..... A47K 10/3687 225/106
4,944,466 A 7/1990 Jespersen
5,271,574 A * 12/1993 Formon ..... A47K 10/36 242/560.3
5,310,129 A 5/1994 Whittington et al.
5,375,785 A * 12/1994 Boone ..... A47K 10/26 242/560.1
5,400,982 A * 3/1995 Collins ..... A47K 10/3687 242/560
5,449,127 A 9/1995 Davis
5,558,302 A * 9/1996 Jesperson ..... A47K 10/3687 242/560
5,570,938 A 11/1996 Butler
5,604,992 A 2/1997 Robinson
5,628,474 A 5/1997 Krueger et al.
5,636,812 A 6/1997 Conner et al.
5,749,538 A 5/1998 Brown et al.
5,772,291 A * 6/1998 Byrd ..... A47K 10/36 242/563.2
5,868,335 A 2/1999 Lebrun
5,873,542 A 2/1999 Perrin
5,979,822 A * 11/1999 Morand ..... A47K 10/3656 242/560
6,089,499 A 7/2000 Robinson
6,145,779 A 11/2000 Johnson et al.
6,152,397 A * 11/2000 Purcell ..... A47K 10/3687 242/560.1
6,224,010 B1 5/2001 Morand
6,354,533 B1 * 3/2002 Jespersen ..... A47K 10/36 242/560.1
6,363,824 B1 4/2002 Granger
6,364,245 B1 4/2002 Paal et al.
6,386,479 B1 5/2002 Lewis et al.
6,412,679 B2 * 7/2002 Formon ..... A47K 10/36 225/10
6,491,251 B1 12/2002 Stanland et al.
6,508,432 B2 1/2003 Krivulin
6,592,067 B2 * 7/2003 Denen ..... A47K 10/3687 242/560
6,607,160 B2 8/2003 Lewis et al.
6,616,087 B1 9/2003 Chern
6,619,504 B2 9/2003 Ozimec
6,695,246 B1 * 2/2004 Elliott ..... A47K 10/36 242/563
6,715,637 B1 4/2004 Ramos
6,736,348 B1 * 5/2004 Formon ..... A47K 10/3687 242/559.4
6,826,985 B2 * 12/2004 Broehl ..... B65H 35/08 225/1
6,892,620 B2 * 5/2005 Kapiloff ..... A47K 10/36 225/14
6,959,891 B2 11/2005 Kapiloff et al.
7,014,140 B2 3/2006 Elliott et al.
7,040,566 B1 * 5/2006 Rodrian ..... A47K 10/36 242/563
7,182,288 B2 * 2/2007 Denen ..... A47K 10/3687 242/560
7,185,841 B2 * 3/2007 Kaufmann ..... A47K 10/32 242/564.4
7,185,843 B1 3/2007 Li
7,309,042 B2 12/2007 Rigas
7,793,882 B2 * 9/2010 Reinsel ..... A47K 10/36 242/563
7,841,556 B2 11/2010 Elliott et al.
7,913,945 B2 3/2011 Friesen et al.
8,066,217 B2 * 11/2011 Cittadino ..... A47K 10/3625 242/563
8,162,252 B2 4/2012 Cittadino et al.
8,282,033 B2 * 10/2012 Achton ..... A47K 10/3687 242/560.1
8,439,293 B2 5/2013 Ophardt
8,479,957 B2 7/2013 Ophardt
8,496,198 B2 7/2013 Cittadino et al.
8,616,489 B2 * 12/2013 Goeking ..... A47K 10/26 242/563.1
8,763,947 B2 * 7/2014 Keily ..... A47K 10/3637 242/564.2
8,882,021 B2 * 11/2014 Cittadino ..... A47K 10/36 242/563.2
9,195,861 B2 * 11/2015 Bigari ..... B26D 5/34
9,681,783 B2 * 6/2017 Goeking ..... A47K 10/26
2002/0050544 A1 5/2002 Stanland et al.
2002/0109035 A1 * 8/2002 Denen ..... A47K 10/3687 242/559.1
2003/0110911 A1 * 6/2003 Kapiloff ..... A47K 10/36 83/208
2003/0116003 A1 * 6/2003 Kapiloff ..... A47K 10/36 83/649
2003/0146337 A1 8/2003 Moody et al.
2004/0134924 A1 * 7/2004 Hansen ..... A47K 10/36 221/9
2005/0171634 A1 8/2005 York et al.
2006/0118993 A1 6/2006 Awofeso et al.
2006/0236836 A1 10/2006 Cassia
2007/0290094 A1 12/2007 Anderson
2008/0018302 A1 1/2008 Reinsel et al.
2008/0078777 A1 * 4/2008 Cittadino ..... A47K 10/36 221/1
2008/0078855 A1 4/2008 Forman et al.
2008/0121649 A1 5/2008 Kistner
2008/0128448 A1 * 6/2008 Cittadino ..... A47K 10/36 221/11
2008/0245922 A1 * 10/2008 Fellhoelter ..... A47K 10/36 242/554.6

(56) References Cited

U.S. PATENT DOCUMENTS

| | | | | |
|---|---|---|---|---|
| 2010/0078459 | A1* | 4/2010 | Reinsel | A47K 10/36 225/10 |
| 2010/0286817 | A1* | 11/2010 | Goeking | A47K 10/26 700/231 |
| 2010/0286818 | A1 | 11/2010 | Goeking et al. | |
| 2011/0139920 | A1 | 6/2011 | Formon et al. | |
| 2011/0253829 | A1 | 10/2011 | Goeking et al. | |
| 2012/0255413 | A1 | 10/2012 | Osborne, Jr. | |
| 2013/0161346 | A1* | 6/2013 | Wolme | A47K 10/38 221/26 |
| 2013/0320130 | A1 | 12/2013 | Osborne, Jr. | |
| 2014/0103133 | A1 | 4/2014 | Muderlak et al. | |
| 2014/0246469 | A1 | 9/2014 | Forsaeus et al. | |
| 2015/0060591 | A1 | 3/2015 | Gutierrez | |
| 2015/0157177 | A1 | 6/2015 | Carper et al. | |
| 2015/0190018 | A1 | 7/2015 | Pherson et al. | |
| 2015/0238056 | A1 | 8/2015 | Fellhoelter | |
| 2015/0289730 | A1 | 10/2015 | Keily et al. | |

* cited by examiner

TOWEL CONSUMPTION MODEL OUTPUT
DISPLAYS OUTPUT OF CONSUMPTION MODEL OVER 7 SERVICE CYCLES FOR PRIOR ART AS WELL AS THE INVENTION

ASSUMPTIONS
DISPENSER MUST NOT RUN OUT OF TOWEL (TOP PRIORITY)
STUB ROLL IS TO BE USED IF IT WILL FIT IN DISPENSER
STUB ROLLS THAT ARE TOO LARGE MAY NOT BE PLACED OUTSIDE OF DISPENSER (MUST BE DISCARDED)
PERIOD IS FROM THE BEGINNING OF SERVICE CYCLE 1 TO THE END OF SERVICE CYCLE 7 (DOES NOT INCLUDE CUSTODIAN RESPONSE AT END OF CYCLE 7)

| CUSTODIAN RESPONSE | MEANING |
|---|---|
| OK | TOWEL SUPPLY ADEQUATE, NO ACTION REQUIRED |
| ROTATE | ROTATE CAROUSEL, INSTALL NEW ROLL (USES STUB ROLL), INCLUDES INSTANCES WHERE NO PAPER IS LEFT ON EITHER ROLL HOLDER |
| DISCARD | DISCARD STUB ROLL, INSTALL NEW ROLL (STUB ROLL FOOTAGE WASTED) |
| NO TOWEL | TOWEL OUT (DISPENSER EMPTY UNTIL NEXT SERVICE) |

PRIOR ART (1001' PRIMARY ROLL, 198' MAX STUB ROLL)

| | | | | | | | | | | | | | | | |
|---|---|---|---|---|---|---|---|---|---|---|---|---|---|---|---|
| INITIAL ROLL | UPPER ROLL | 1001 | | | | | | | | | | | | | |
| FOOTAGE | LOWER ROLL | 0 | | | | | | | | | | | | | |
| MAXIMUM STUB ROLL FOOTAGE | | 198 | | | | | | | | | | | | | |
| FOOTAGE USED PER SERVICE CYCLE | | 410 | | | | | | | | | | | | | |
| SERVICE CYCLE | | 1 | | 2 | | 3 | | 4 | | 5 | | 6 | | 7 | |
| TIME | | START | END | START | END | START | END | START | END | START | END | START | END | START | END |
| FOOTAGE REMAINING | UPPER ROLL | 1001 | 591 | 591 | 181 | 1001 | 772 | 772 | 362 | 1001 | 591 | 591 | 181 | 1001 | 772 |
| ON ROLL | LOWER ROLL | 0 | -410 | 0 | -410 | 181 | -229 | 0 | -410 | 0 | -410 | 0 | -410 | 181 | -229 |
| CUSTODIAN RESPONSE | | | OK | | ROTATE | | OK | | DISCARD | | OK | | ROTATE | | OK |
| ADDITIONAL FOOTAGE INSTALLED | | | 0 | | 1001 | | 0 | | 1001 | | 0 | | 1001 | | 0 |
| WASTED FOOTAGE | | | 0 | | 0 | | 0 | | 362 | | 0 | | 0 | | 0 |

INVENTION (2 x 536' PRIMARY ROLLS, 536' MAX STUB ROLL)

| | | | | | | | | | | | | | | | |
|---|---|---|---|---|---|---|---|---|---|---|---|---|---|---|---|
| INITIAL ROLL | UPPER ROLL | 536 | | | | | | | | | | | | | |
| FOOTAGE | LOWER ROLL | 536 | | | | | | | | | | | | | |
| MAXIMUM STUB ROLL FOOTAGE | | 536 | | | | | | | | | | | | | |
| FOOTAGE USED PER SERVICE CYCLE | | 410 | | | | | | | | | | | | | |
| SERVICE CYCLE | | 1 | | 2 | | 3 | | 4 | | 5 | | 6 | | 7 | |
| TIME | | START | END | START | END | START | END | START | END | START | END | START | END | START | END |
| FOOTAGE REMAINING | UPPER ROLL | 536 | 536 | 536 | 252 | 536 | 378 | 536 | 504 | 536 | 536 | 536 | 220 | 536 | 346 |
| ON ROLL | LOWER ROLL | 536 | 126 | 126 | -284 | 252 | -158 | 378 | -32 | 504 | 94 | 94 | -316 | 220 | -190 |
| CUSTODIAN RESPONSE | | | OK | | ROTATE | | ROTATE | | ROTATE | | OK | | ROTATE | | ROTATE |
| ADDITIONAL FOOTAGE INSTALLED | | | 0 | | 536 | | 536 | | 536 | | 0 | | 536 | | 536 |
| WASTED FOOTAGE | | | 0 | | 0 | | 0 | | 0 | | 0 | | 0 | | 0 |

| | SUMMARY DATA | | | |
|---|---|---|---|---|
| FOOTAGE USED PER SERVICE CYCLE | ROLL CHANGES | TOTAL FOOTAGE CONSUMED | FOOTAGE WASTED | %WASTE |
| 410 | 3 | 3232 | 362 | 11% |
| 410 | 4 | 2870 | 0 | 0 |

FIG. 5

SYSTEM AND METHOD FOR REDUCING WASTE USING A SHEET PRODUCT DISPENSER

CROSS REFERENCE TO RELATED APPLICATIONS

The present application invention is a continuation of U.S. patent application Ser. No. 13/998,753, filed Dec. 2, 2013, entitled "System and Method for Reducing Waste Using a Sheet Product Dispenser," which claims the benefit of U.S. Provisional Patent Application Ser. No. 61/731,812, filed Nov. 30, 2012, the contents of each being incorporated herein by reference in their entireties.

FIELD OF THE INVENTION

This invention relates generally to a method of reducing waste when using a product dispenser, and to rolled sheet product dispensers useful in the reduction of waste.

BACKGROUND

Sheet product dispensers typically include rolls of sheet product. The sheet product is dispensed from the roll by passing one end of the sheet product through a pair of rollers. One of the rollers is coupled to an electric motor that is selectively energized by a controller. Friction between the rollers and the sheet product pulls the sheet product from the sheet product roll when the motor is operated.

Waste reduction is an important consideration in the design and use of dispensers. One way to reduce waste is to ensure the full contents of a roll are used. To achieve this goal, some dispensers include a means to support two or more rolls of rolled sheet product. One such known dispenser is able to receive two rolls, the left ends of which are substantially aligned in a plane, and the right ends of the rolls are substantially aligned in another plane. Once the roll in the foremost position is depleted, product from the roll in the secondary position may be taken by users.

To satisfy customer desires, some dispensers provide a means of conveying product from a roll to a user. One dispenser is able to receive two full-sized rolls and ends of the rolls are non-planar. The rolls are substantially coaxial and side-by-side. Since the ends of the rolls are not substantially planar, this dispenser requires a separate drive roller and pinch roller for each roll in order to convey product to a user.

Other bath tissue or toilet paper sheet product dispensers can receive two full-sized rolls, the ends of which are aligned in planes so that the dispenser only requires one drive roller to dispense product from either roll, thereby reducing the number of dispenser components required to convey product to a user. However, while only a single drive roller is required, this dispenser requires two pinch rollers in order to convey product to a user because the substrate is less robust.

Other dispensers, known as "stub roll dispensers," can receive one full-sized roll and one partially-depleted roll. One known stub roll dispenser aligns the ends of the rolls in planes and conveys product to a user. This dispenser further reduces the number of dispenser components required to convey product to a user, as it utilizes only one drive roller and only one pinch roller. Since the rolls in this dispenser are arranged vertically, it also reduces the amount of horizontal wall space required for installation. However, use of this type of dispenser demonstrates the need for additional waste reduction. For example, stub roll dispensers are configured to accommodate roll lengths that are a small fraction (e.g. 25% or less) of the original roll length. Therefore, if the stub roll is too large to fit into the stub roll position at the time of servicing, the custodian must either place the stub roll outside of the dispenser cabinet, which is undesirable for both aesthetic and safety reasons, discard the roll or must choose to not service the dispenser. In a washroom with one known stub roll dispenser, removing the stub roll from the dispenser and replacing it with a full sized roll is desirable to prevent the dispenser from running empty of sheet product before the next service cycle.

Historically, the need to reduce waste has focused research and design efforts on increasing the capacity of the full-sized roll. This effort has been unsuccessful, at least in part because this method does nothing to reduce waste due to premature discarding of a stub roll.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

A method of reducing sheet product waste generated during use of a sheet product dispenser in a particular location and over a broad range of usage rates includes designing a dispenser, the design including: determining a desired housing size to obtain a top to bottom height for sheet product roll storage within the housing, dividing the height by two to obtain a maximum roll diameter, and locating two roll holders in the housing so that each holder may accept a roll having the maximum roll diameter, positioning a first roll of the maximum roll diameter in a first one of the two roll holders; and positioning a second roll of the maximum roll diameter in a second one of the two roll holders, so that two rolls of equivalent length are configured to be dispensed sequentially from the dispenser. The installation and use of two rolls of maximum roll diameter reduces waste.

Another method of reducing sheet product waste generated during use of a sheet product dispenser includes: determining the maximum desired capacity of sheet product for a dispenser of a given size; determining the sheet product maximum roll diameter required to provide half of the maximum desired length of sheet product per service cycle; providing a dispenser for the sheet product comprising: space for two rolls of sheet product, each of the maximum roll diameter, two sets of sheet product roll holders, each positioned to accept a roll having the desired maximum roll diameter, a means to dispense the sheet product out of the dispenser, and a means to enable sheet product to be dispensed sequentially from one roll then from the second roll; positioning a first sheet product roll of the desired roll length in a first one of the two sets of sheet product roll holders in the dispenser; and positioning a second sheet product roll of the desired roll length in a second one of the two sets of sheet product roll holders in the dispenser.

A dispenser for rolled sheet product may be formed according to the methods described above. The dispenser may include: space for two substantially identical rolls of sheet product; two sets of sheet product roll holders, each positioned to accept a roll substantially the same diameter, with one roll positioned above the other; one mechanism to dispense sheet. product from the dispenser; and a means to enable sheet product to be dispensed sequentially from one roll then from the second roll.

Another sheet towel roll dispenser may be formed according to the methods described above and may include: two sets of sheet towel roll holders, wherein (i) one set is in a position in the dispenser that is large enough to accept a full-sized roll, and (ii) the other set is in a position in the dispenser that is large enough to accept a roll at least 67% as long as, but not substantially larger than, the full-sized roll, (b) one drive roller, substantially the same length as a roll of towel, and (c) one pinch roller, substantially the same length as a roll of towel.

The dispenser may dispense sheet towel product from a roll in a primary position in the dispenser before dispensing from a roll in a secondary position in the dispenser. Either sheet towel roll holder in one set may be substantially planar to a corresponding sheet towel roll holder in the other set. Alternatively, the ends of the drive roller may be substantially planar to either sheet towel roll holder in a set.

A sheet product dispenser formed according to one of the above methods may include: (a) two sets of sheet product roll holders, wherein (i) one set is in a position in the dispenser that is large enough to accept a full-sized roll, and (ii) the other set is in a position in the dispenser that is large enough to accept a roll at least 67% as long as, but not substantially larger than, the full-sized roll, (b) one drive roller, substantially the same axial length as a roll of product, and (c) one pinch roller, substantially the same axial length as a roll of product.

The dispenser may dispense product from a roll in a primary position in the dispenser before dispensing from a roll in a secondary position in the dispenser. Either sheet product roll holder in one set may be substantially planar to a corresponding sheet product roll holder in the other set. Alternatively, the ends of the drive roller are substantially planar to either sheet product roll holder in a set.

BRIEF DESCRIPTION OF THE DRAWINGS

Illustrative embodiments of the present invention are described in detail below with reference to the following drawing figures:

FIG. 5 is an illustration of the waste savings when using two 536 foot initial rolls versus a 1000 foot primary roll.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of this invention include a system and method for minimizing waste over a broad range of usage rates. Embodiments of this invention may be used with the dispenser described in US 2010/0286818, which is hereby incorporated by reference in its entirety.

Figure 6:
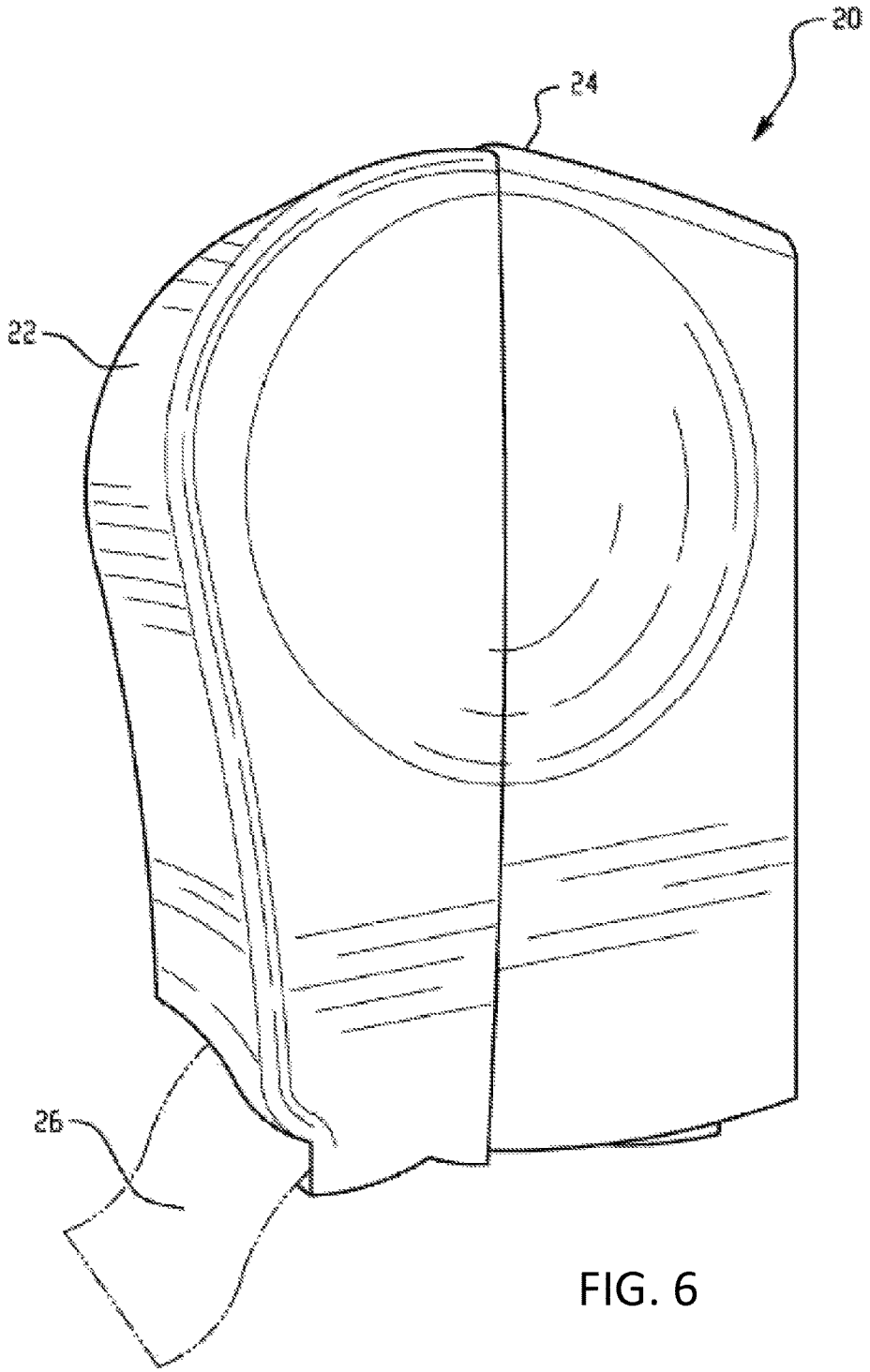
FIG. 6 is a perspective view of a sheet product dispenser in accordance with an embodiment of the present invention.
Figure 7:
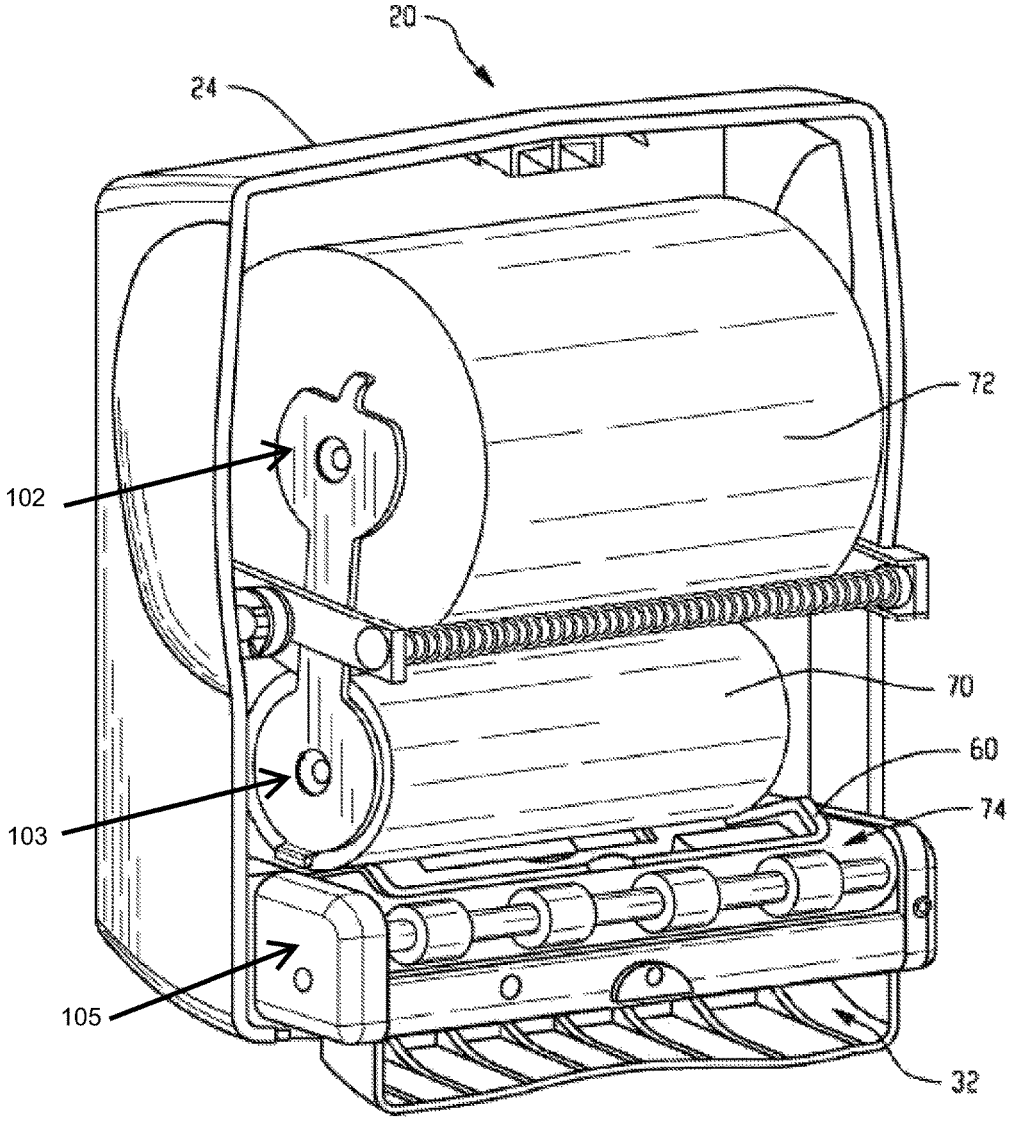
FIG. 7 is a perspective view of the sheet product dispenser of FIG. 6 with the front cover removed.
Figure 8:
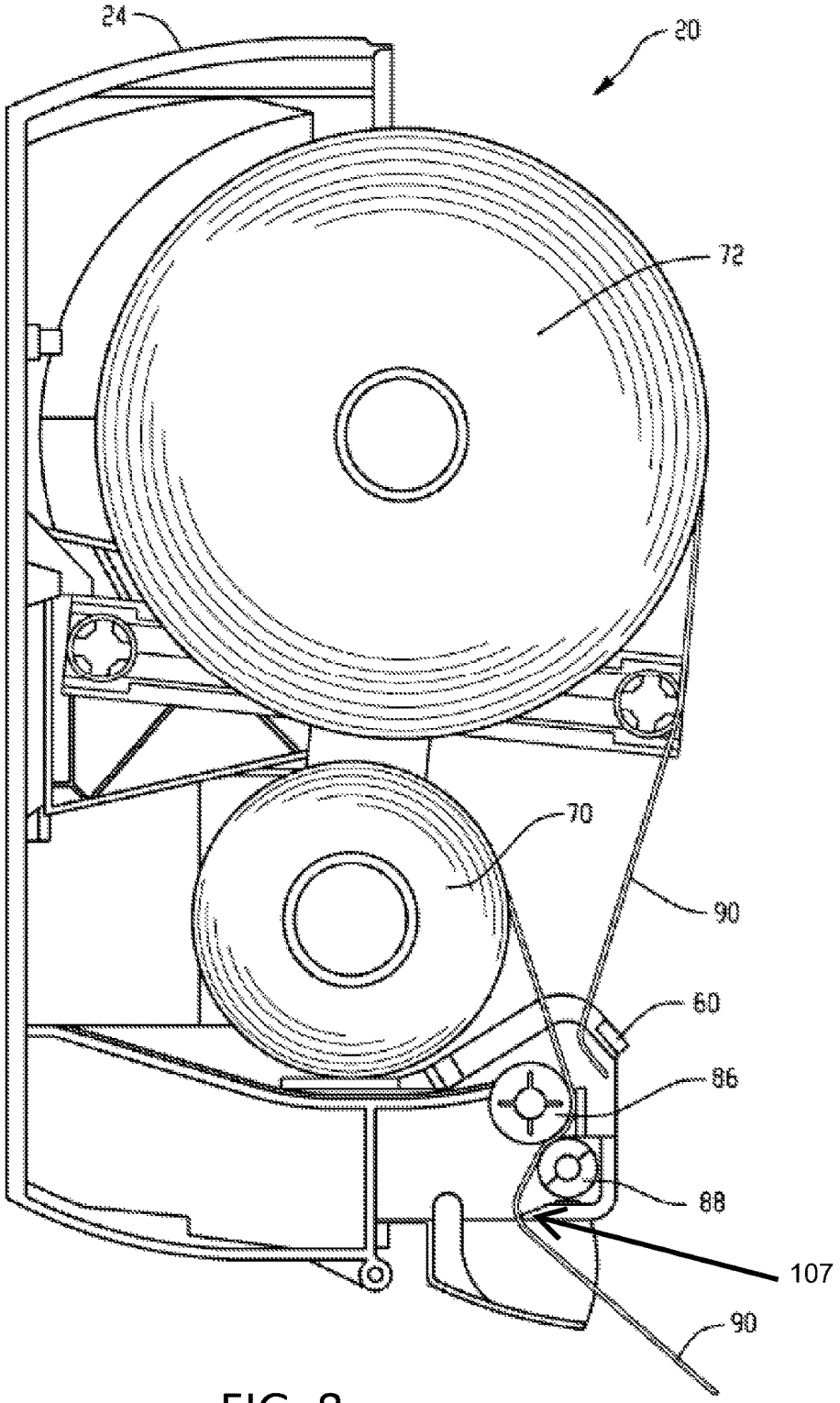
FIG. 8 is a side plan view of the sheet product dispenser of FIG. 6 with the front cover removed.

In particular, as shown in FIGS. 6-8, one embodiment of a sheet product dispenser 20 includes a front cover 22 and a back plate 24 that is arranged to hold and dispense a sheet product 26. The dispensing mechanism may include a transfer bar 60 that is activated by an actuator. The transfer bar acts to move the end portion of sheet product 26 on main roll 72 from a first position to a second position where it engages the rollers in roller assembly 74 and may thereafter be dispensed. Two sheet product rolls 70, 72 are mounted on roll holders 103, 102, respectively, via rolls or core stock. Maintenance personnel manually refill the sheet product dispenser 20 and position the second roll 70 within the lower or tapered portion 30. This second roll 70 may be a stub roll since it usually, but not necessarily, contains only a portion of the sheet product of a new/full sheet product roll. However, in one embodiment the stub roll 70 can be a new or full sheet product roll. The stub roll 70 feeds sheet product to a roller assembly 74 that includes a pair of rollers that pull the sheet product when activated by the motor (e.g., contained within a portion 105 of the sheet product dispenser 20).

After the roller assembly 74 pulls the sheet product from either the stub roll 70 or the main roll 72, the sheet product proceeds to the tear bar assembly. The tear bar assembly 107 is positioned adjacent the dispensing slot 32. A means for cutting the sheet product 26 is included in the tear bar assembly once the appropriate amount of sheet product 26 has been dispensed. The tear bar assembly may separate the dispensed sheet product using a sharp edge that cuts into the sheet when the user pulls the dispensed sheet product 26. The separation of the sheet product 26 from the sheet product roll 70, 72 may then be used and discarded as necessary by the user.

In this embodiment, the stub roll 70 and main roll 72 are arranged with the main roll 72 being in the upper portion and the stub roll 70 in the lower portion of sheet product dispenser 20. The roller assembly 74 includes a feed roller 86 and a pinch roller 88. The location where the rollers meet is commonly referred to as the "nip." The feed roller 86 is coupled for rotation to the motor. When maintenance or refill operations are performed on the sheet product dispenser 20, the stub roll 70 is positioned in the lower portion and the leading edge portion 90 of the sheet product 26 from stub roll 70 is inserted between the feed roller 86 and the pinch roller 88 at the nip. Friction between the rollers 86 and 88 and the sheet product 26 causes sheet product 26 to be pulled from the stub roll 70 when the motor is activated. Maintenance personnel may also position the main roll 72 in the sheet product dispenser 20. The main roll 72 includes a leading edge portion 90 that is positioned adjacent the transfer bar 60. An arm on the transfer bar 60 extends parallel to the feed roller 86 transversely across the front of the sheet product dispenser 20 to engage the main roll leading edge portion 90.

Figure 1:
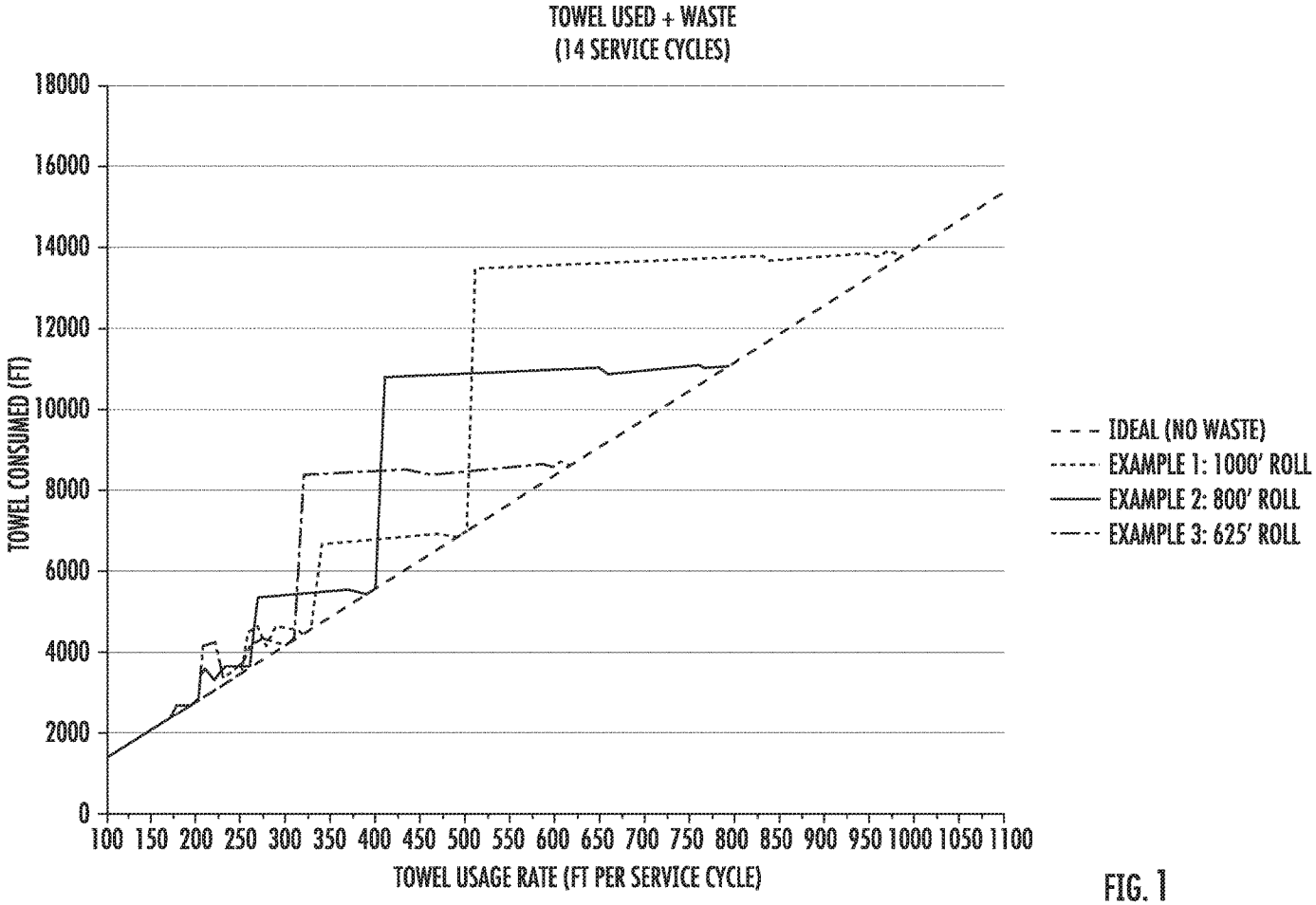
FIG. 1 is an illustration of towel consumption as a function of usage rate.

FIG. 1 illustrates towel consumption as a function of usage rate. Towel consumption is the sum of towel usage and towel waste. Specifically, FIG. 1 compares consumption over a range of usage rates. Usage rate refers to the amount of towel used in linear feet per service cycle. A service cycle is the period of time between custodian visits for review and restocking. As shown in FIG. 1, the general profile of the traces remains constant, regardless of the roll footage. Increasing the roll length simply moves the trace to the right on the plot. The roll length that yields the least waste depends on which towel usage rate is in effect. Generally, users prefer rolls having higher capacity.

Figure 2:
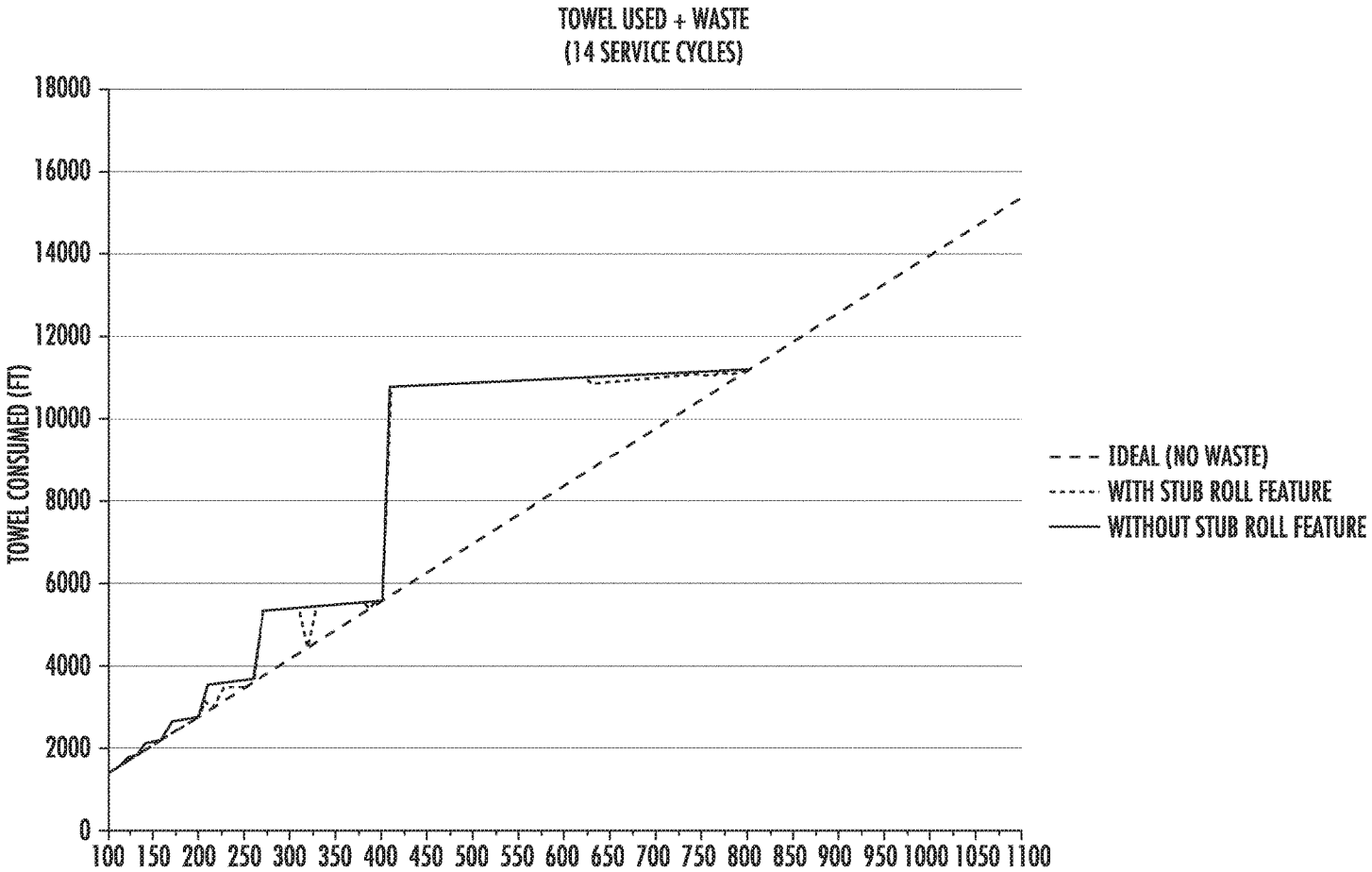
FIG. 2 is an illustration of the comparison between a dispenser having a stub roll in use and a dispenser with a stub roll not in use.

FIG. 2 illustrates the comparison between a dispenser having a stub roll in use and a dispenser having a stub roll not in use. Unexpectedly, the traces are almost overlapping, with only minor variance. Thus, the stub roll feature provides little advantage for minimizing waste when not used properly.

Figure 3:
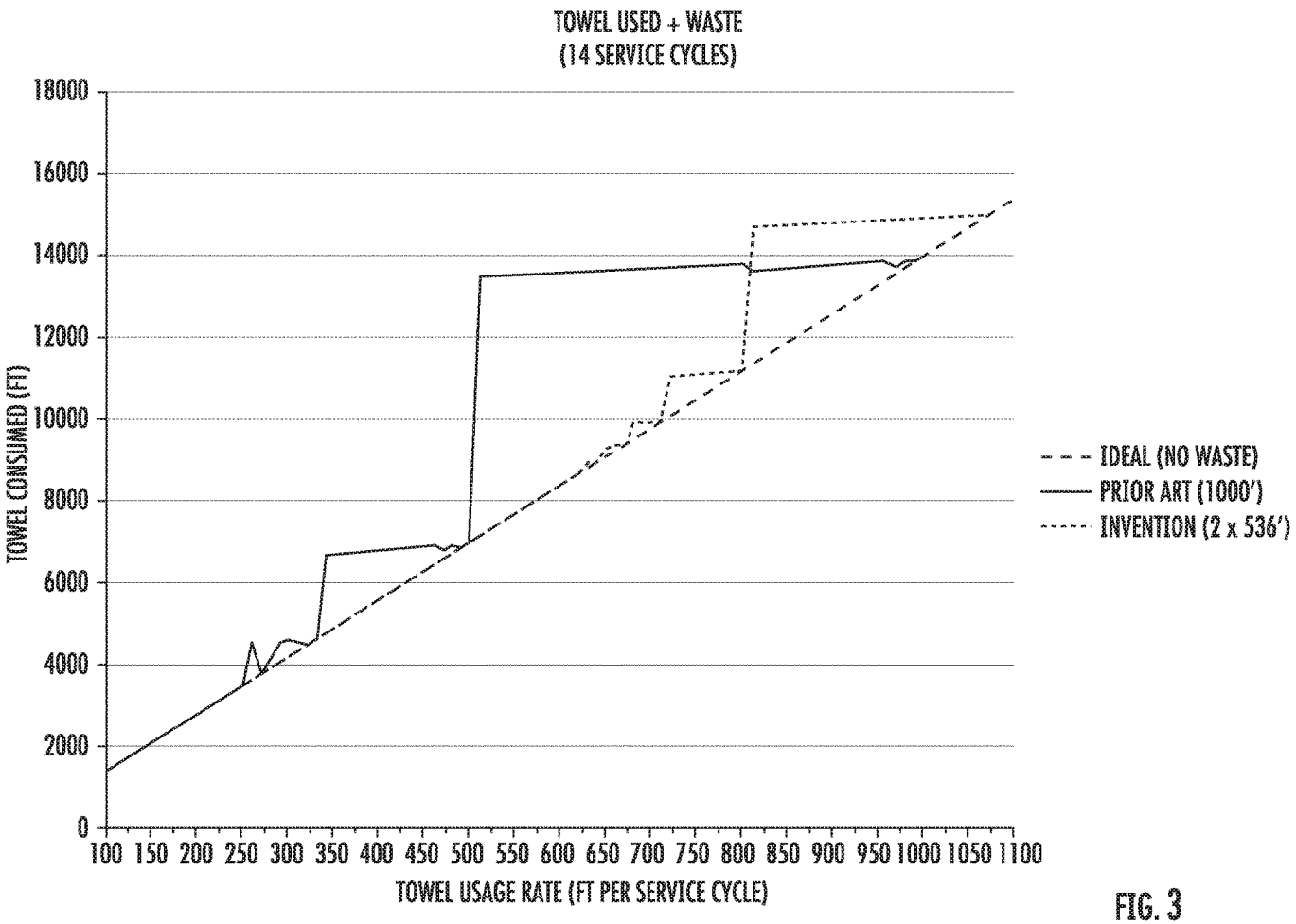
FIG. 3 is an illustration of towel consumption using an embodiment according to the present invention.

FIG. 3 illustrates towel consumption using an embodiment of this invention. A dispenser of an embodiment of this invention offers minimal waste over a wider range of towel usage rates and provides a high capacity dispenser.

Figure 4:
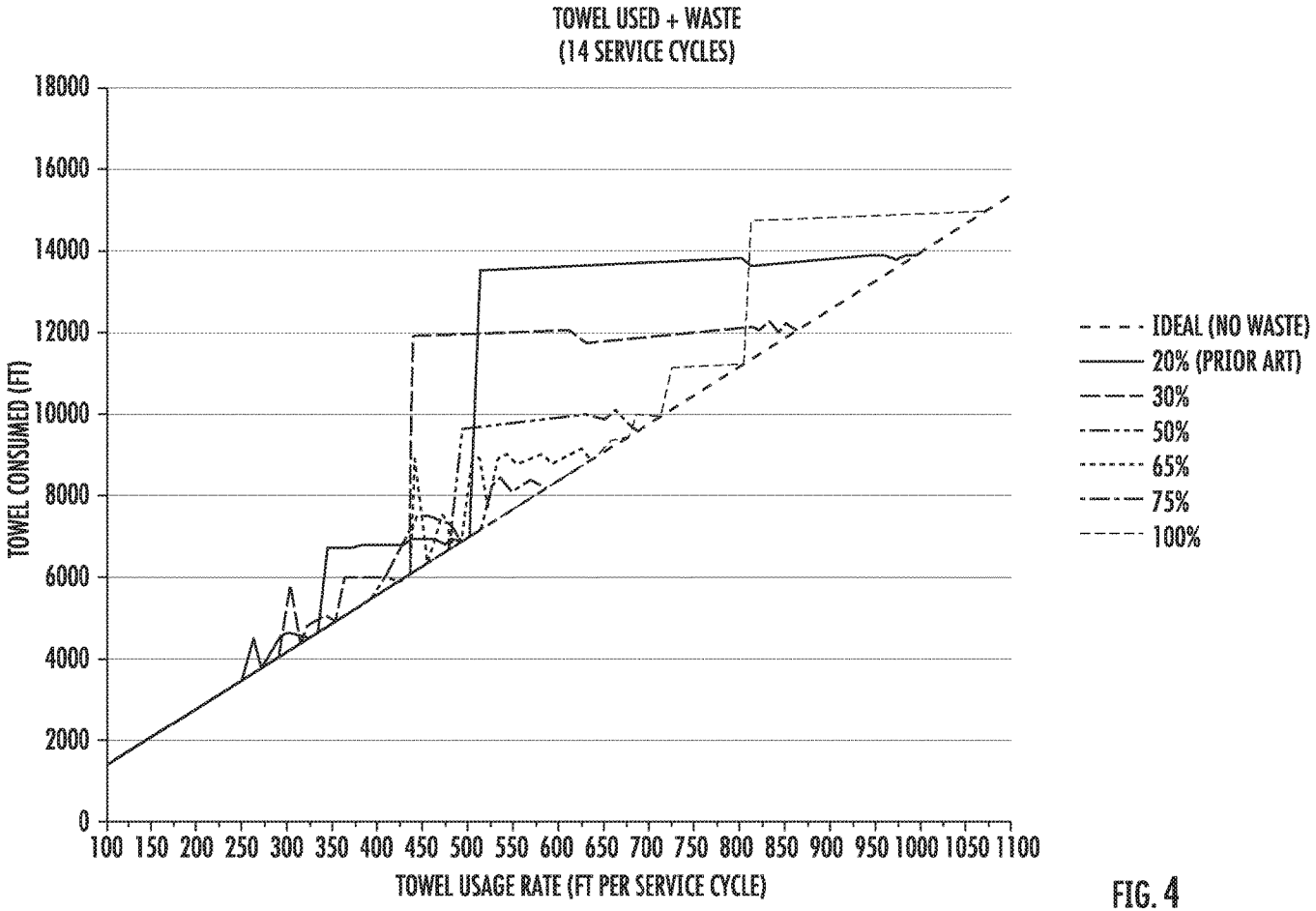
FIG. 4 is an illustration of an example of waste at various percentages of stub roll size to primary roll size.

FIG. 4 illustrates an example of waste at various percentages of stub roll size to primary roll size. In FIG. 4, the primary roll size is 1000 feet. The consumption for each of six stub roll sizes as a percentage of the primary roll length is illustrated.

In one embodiment of this invention, the stub roll length is increased to 67% as long as a full sized roll. Compared to a stub roll length that is 50% as long as a full sized roll, increasing the stub roll length to 67% as long as a full-sized roll substantially reduces waste due to premature discarding. This is true even if two smaller sized rolls of equal length must be used. In another embodiment of this invention, the stub roll length is increased in size to 100% of the length of a full-sized roll. In this embodiment, towel waste due to premature discarding of the roll is further reduced. This reduction occurs even if a full-sized roll must be decreased in length to make room for both rolls within a dispenser design.

Thus, a system and method of reducing waste utilizing a dispenser capable of receiving two rolls of substantially equal size can reduce the occurrence of waste. In one embodiment, two identically sized rolls are used in a dispenser. Partially used rolls may be moved to the stub roll position to allow installation of a full-sized roll in the primary roll position. By way of example, FIG. 5 illustrates the waste savings when using two 536 foot initial rolls versus a 1000 foot primary roll.

Infrequently, a high usage rate may require entirely discarding a partially used roll to make sure the dispenser does not run empty prior to the next service cycle. As shown in FIG. 4, the closer the two rolls are in size for a given dispenser size, the less waste is generated by premature discarding. The closer the stub roll capacity is to the length of the primary roll, the better chance there is for use of the stub roll.

Embodiments of this invention include a drive roller comprising a cylinder that may rotate and communicate with rolled sheet product in order to convey the sheet product from inside of the dispenser housing to the outside of the dispenser housing. A drive roller may rotate once, more than once, or less than once in order to deliver an appropriate length of sheet product for a user. In other embodiments, a drive roller may be of a shape other than a cylinder. In other embodiments, a drive roller may include a feature such as a cutting knife or a tear blade. In one embodiment, the drive roller is substantially the same axial length as the axial length of a roll of product.

Embodiments of this invention include a pinch roller comprising a cylinder that may rotate and communicate with rolled sheet product in order to cause the sheet product to touch the drive roller, thereby enabling the drive roller to convey product to a user. In other embodiments, a drive roller may be of a shape other than a cylinder. In other embodiments, a drive roller may be non-rotational.

In one embodiment, two full-sized sheet product rolls have the same length and diameter, and both sets of sheet product roll holders are positioned in the dispenser with enough room so that each set of sheet product roll holders may simultaneously receive a full-sized roll of product. However, manufacturing tolerances, premature usage, etc., may cause differences in length and diameter between two full-sized rolls.

Practical design considerations as well as customer preferences may affect some embodiments. For example, one set of roll holders may be positioned in the dispenser without sufficient room to receive a completely full-sized roll, but that can accommodate a roll that is at least 67% as long as a full-sized roll. In that case, a full size roll and the smaller roll may be used.

In one embodiment, the web paths for each of the primary and the stub rolls traverse the same components. In this manner, a dispenser can be made smaller, simpler, and less expensive, such as by using only one drive roller, pinchroller, paper chute, etc. to dispense from either of the rolls of product. Horizontal space on a wall may be limited in a washroom environment, and that in many embodiments, a narrow, taller dispenser with two full-sized rolls arranged vertically is more useful than a short, wide dispenser with two similar-sized rolls arranged side-by-side.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

The invention claimed is:

1. A sheet product dispenser comprising:

a housing comprising a cover and rear portion;

a first roll holder within the housing, wherein the first roll holder is configured to receive a first full-sized roll of sheet product having a first length;

a second roll holder within the housing, wherein the second roll holder is configured to receive a second full-sized roll of sheet product having a second length, wherein the first length and the second length are a same length, wherein the first roll holder is positioned above the second roll holder within the housing;

wherein the housing is sized such that the first roll holder and the second roll holder are configured to receive and hold the first roll of sheet product and the second roll of sheet product simultaneously;

at least one mechanism configured to dispense sheet product from at least one of the first roll of sheet product and the second roll of sheet product, wherein the at least one mechanism comprises at least one drive roller and at least one pinch roller; and a single motor configured to drive the at least one drive roller of the at least one mechanism to dispense sheet product from either the first roll of sheet product or the second roll of sheet product, wherein the single motor is configured to cause the at least one drive roller to rotate to cause a full dispensed portion of the sheet product from either the first roll of sheet product or the second roll of sheet product to be presented for retrieval by a user without the user needing to pull on the full dispensed portion to further rotate the drive roller, wherein the single motor is configured to cause sheet product to be dispensed sequentially from the first roll of sheet product until the first roll of sheet product is depleted and then from the second roll of sheet product, wherein the cover is configured to be opened to enable a user to replace the depleted first roll of sheet product with a third full-sized roll of sheet product having a third length while the second full-sized roll of sheet product is received by the second roll holder, wherein the third length is the same as the first length, wherein the single motor is configured to operate, in an instance in which the third full-sized roll of sheet product replaced the depleted first roll of sheet product, to cause sheet product to continue to be dispensed from the second roll of sheet product while the second roll of sheet product is received within the second roll holder and the third roll of sheet product is received within the first roll holder.

2. The sheet product dispenser of claim 1, wherein the single motor is configured to cause the at least one drive roller to rotate at least one full rotation to cause the full dispensed portion of the sheet product from either the first roll of sheet product or the second roll of sheet product to be presented for retrieval by the user.

3. The sheet product dispenser of claim 1, wherein the at least one mechanism comprises a single drive roller.

4. The sheet product dispenser of claim 1, wherein the at least one mechanism comprises a single pinch roller.

5. The sheet product dispenser of claim 1 further comprising at least one tear bar assembly configured to enable separation of the full dispensed portion from either the first roll of sheet product or the second roll of sheet product.

6. The sheet product dispenser of claim 1 further comprising a transfer bar.

7. The sheet product dispenser of claim 1, wherein the first roll of sheet product has a first diameter, wherein the second roll of sheet product has a second diameter, and wherein the first diameter and the second diameter are the same.

8. The sheet product dispenser of claim 1, wherein the first roll holder and the second roll holder are positioned within the housing such that the first roll of sheet product is vertically above the second roll of sheet product when the first roll of sheet product is received within the first roll holder and the second roll of sheet product is received within the second roll holder.

9. The sheet product dispenser of claim 1, wherein the housing and the at least one mechanism are configured such that at least a portion of a first web path for sheet product from the first roll of sheet product traverses at least one same component of the at least one mechanism as at least a portion of a second web path for sheet product from the second roll of sheet product, wherein the at least one same component is at least one of the drive roller or a pinch roller.

10. A method of operating a sheet product dispenser comprising:

providing a sheet product dispenser comprising:

a housing comprising a cover and rear portion;

a first roll holder within the housing, wherein the first roll holder is configured to receive a first full-sized roll of sheet product having a first length;

a second roll holder within the housing, wherein the second roll holder is configured to receive a second full-sized roll of sheet product having a second length, wherein the first length and the second length are a same length, wherein the first roll holder is positioned above the second roll holder within the housing;

wherein the housing is sized such that the first roll holder and the second roll holder are configured to receive and hold the first roll of sheet product and the second roll of sheet product simultaneously;

at least one mechanism configured to dispense sheet product from at least one of the first roll of sheet product and the second roll of sheet product, wherein the at least one mechanism comprises at least one drive roller and at least one pinch roller; and a single motor configured to drive the at least one drive roller of the at least one mechanism to dispense sheet product from either the first roll of sheet product or the second roll of sheet product, wherein the single motor is configured to cause the at least one drive roller to rotate to cause a full dispensed portion of the sheet product from either the first roll of sheet product or the second roll of sheet product to be presented for retrieval by a user without the user needing to pull on the full dispensed portion to further rotate the drive roller;

operating the sheet product dispenser to cause the single motor to cause sheet product to be dispensed sequentially from the first roll of sheet product until the first roll of sheet product is depleted and then from the second roll of sheet product; and operating, in an instance in which a third full-sized roll of sheet product replaced the depleted first roll of sheet product, the sheet product dispenser to cause the single motor to cause sheet product to continue to be dispensed from the second roll of sheet product while the second full-sized roll of sheet product is received within the second roll holder and the third full-sized roll of sheet product is received within the first roll holder, wherein the third full-sized roll of sheet product has a third length, and wherein the third length is the same as the first length.

11. The method of claim 10, wherein the single motor of the sheet product dispenser is configured to cause the at least one drive roller to rotate at least one full rotation to cause the full dispensed portion of the sheet product from either the first roll of sheet product or the second roll of sheet product to be presented for retrieval by the user.

12. The method of claim 10, wherein the at least one mechanism of the sheet product dispenser comprises a single drive roller.

13. A sheet product dispenser comprising:

a housing comprising a cover and rear portion;

a first roll holder within the housing, wherein the first roll holder is configured to receive a first full-sized roll of sheet product having a first length;

a second roll holder within the housing, wherein the second roll holder is configured to receive a second full-sized roll of sheet product having a second length, wherein the second length and the first length are a same length;

at least one mechanism configured to dispense sheet product from at least one of the first roll of sheet product and the second roll of sheet product, wherein the at least one mechanism comprises at least one drive roller and at least one pinch roller; and a single motor configured to drive the at least one drive roller of the at least one mechanism to dispense sheet product from either the first roll of sheet product or the second roll of sheet product, wherein the single motor is configured to cause the at least one drive roller to rotate to cause a full dispensed portion of the sheet product from either the first roll of sheet product or the second roll of sheet product to be presented for retrieval by a user without the user needing to pull on the full dispensed portion to further rotate the drive roller, wherein the single motor is configured to cause sheet product to be dispensed sequentially from the first roll of sheet product until the first roll of sheet product is depleted and then from the second roll of sheet product, wherein the cover is configured to be opened to enable a user to replace the depleted first roll of sheet product with a third full-sized roll of sheet product having a third length while the second full-sized roll of sheet product is received by the second roll holder, wherein the third length is the same as the first length, wherein the single motor is configured to operate, in an instance in which the third full-sized roll of sheet product replaced the depleted first roll of sheet product, to cause sheet product to continue to be dispensed from the second roll of sheet product while the second roll of sheet product is received within the second roll holder and the third roll of sheet product is received within the first roll holder, wherein the housing and the at least one mechanism are configured such that at least a portion of a first web path for sheet product from the first roll of sheet product traverses at least one same component of the at least one mechanism as at least a portion of a second web path for sheet product from the second roll of sheet product, wherein the at least one same component is at least one of the drive roller or a pinch roller.

14. The sheet product dispenser of claim 13, wherein the single motor is configured to cause the at least one drive roller to rotate at least one full rotation to cause the full dispensed portion of the sheet product from either the first roll of sheet product or the second roll of sheet product to be presented for retrieval by the user.

15. The sheet product dispenser of claim 13, wherein the at least one mechanism comprises a single drive roller.

16. The sheet product dispenser of claim 13, wherein the at least one mechanism comprises a single pinch roller.

* * * * *